US012808621B2

(12) United States Patent
Steinhauser et al.

(10) Patent No.: US 12,808,621 B2
(45) Date of Patent: Nov. 24, 2026

(54) MULTIPART TRUNNION AND AMBIDEXTROUSLY MOUNTABLE BARREL FOR FIREARMS

(71) Applicant: CHD Holdings, LLC, Nashville, TN (US)

(72) Inventors: Matthew R. Steinhauser, Philadelphia, PA (US); Kristopher Lee Paulson, Hendersonville, TN (US)

(73) Assignee: CHD Holdings, LLC, Nashville, TN (US)

( * ) Notice: Subject to any disclaimer, the term of this patent is extended or adjusted under 35 U.S.C. 154(b) by 0 days.

(21) Appl. No.: 18/829,532

(22) Filed: Sep. 10, 2024

(65) Prior Publication Data

US 2025/0102258 A1 Mar. 27, 2025

Related U.S. Application Data

(60) Provisional application No. 63/538,803, filed on Sep. 16, 2023.

(51) Int. Cl.
*F41A 21/48* (2006.01)

(52) U.S. Cl.
CPC ..... *F41A 21/48* (2013.01)

(58) Field of Classification Search
CPC ..... F41A 21/48; F41A 21/481; F41A 21/482; F41A 21/484; F41A 21/485
See application file for complete search history.

(56) References Cited

U.S. PATENT DOCUMENTS

| | | | | |
|---|---|---|---|---|
| 8,782,943 | B2 * | 7/2014 | Jarboe | F41A 21/48 42/75.02 |
| 9,777,975 | B2 * | 10/2017 | Folkestad, II | F41A 3/66 |
| 12,435,939 | B1 * | 10/2025 | Sugg | F41A 21/325 |
| 2008/0168695 | A1 * | 7/2008 | Nakayama | F41A 21/481 42/75.02 |
| 2014/0115938 | A1 * | 5/2014 | Jarboe | F41A 21/485 42/71.01 |
| 2015/0007478 | A1 * | 1/2015 | Barrett | F41A 21/481 42/75.02 |
| 2015/0247695 | A1 * | 9/2015 | Jarboe | F41G 11/003 42/71.01 |
| 2016/0033218 | A1 * | 2/2016 | Folkestad, II | F41A 3/66 42/2 |

(Continued)

*Primary Examiner* — Jonathan C Weber
(74) *Attorney, Agent, or Firm* — Eric B. Fugett; Mark A. Pitchford; Pitchford Fugett, PLLC

(57) ABSTRACT

A multipart trunnion assembly for a firearm can include a trunnion body defining an aperture extending longitudinally therethrough and a trunnion insert configured to be secured in the aperture. The trunnion insert defines an interior space in which a barrel of the firearm is receivable to mount the barrel to the trunnion body when the trunnion insert is secured in the aperture. An ambidextrously mountable barrel assembly for a firearm comprises a threadless barrel and a barrel lug sleeve configured to be secured on the barrel. The barrel lug sleeve is configured to be engaged with a plurality of non-helical barrel locking lugs on an interior surface of a threadless trunnion in which the barrel is receivable to mount the barrel to the trunnion when the barrel lug sleeve is secured on the barrel, received in the trunnion, and rotated in either a clockwise or a counterclockwise direction about the barrel.

18 Claims, 10 Drawing Sheets

(56) References Cited

U.S. PATENT DOCUMENTS

| | | | | |
|---|---|---|---|---|
| 2022/0236029 | A1* | 7/2022 | Landies, III | F41A 21/484 |
| 2023/0128014 | A1* | 4/2023 | Makowski | F41A 21/48 89/1.4 |

* cited by examiner

MULTIPART TRUNNION AND AMBIDEXTROUSLY MOUNTABLE BARREL FOR FIREARMS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This non-provisional patent application claims priority to U.S. Provisional Patent Application Ser. No. 63/538,803, filed Sep. 16, 2023 and titled "LIGHT MACHINE GUN," the entire disclosure of which is hereby incorporated by reference.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

The present invention relates generally to the field of firearms, and more particularly, to trunnions and barrels for firearms.

Many modern firearms, including most belt fed machine guns, include a monolithic component known as a "trunnion" that connects the barrel to the body (i.e., receiver) of the firearm. In some weapon systems, the trunnion can provide additional functionalities, such as facilitating a quick-change system for threaded barrels, providing a mounting point for a rear sight implement, housing the bulk of piston or gas operating systems, providing a mounting surface for bipods or tripods, or providing locking surfaces for the bolt of both semi- and fully automatic firearms. Because trunnions contain numerous intricate geometries and perform a variety of critical functions of a firearm, they are usually manufactured from steel forgings or intricately machined from steel billet. As a result, trunnions are universally heavy, and extremely difficult and costly to manufacture.

Another problem with traditional trunnions is wear. Trunnion wear increases with rate of fire and number of rounds fired, in that the more and faster a firearm is discharged, the greater the wear on the trunnion. This is especially problematic for machine guns, as the higher volume of fire wears the trunnion out much faster than would otherwise be the case under semi-automatic fire due to the sustained heat and pressure. As such, the useful life of machine gun trunnions is lower than for semi-automatic weapons and typically estimated based on round count. For example, the useful life of currently available trunnions for a belt fed machine gun such as the M240 chambered in 7.62 mm is usually estimated to be about 250,000 rounds. The trunnions of machine guns chambered in any of the relatively larger and more powerful cartridges increasingly favored by the United States military (e.g., .338 Norma) are expected to wear out even faster. When a trunnion wears out, it typically means the firearm has exceeded its life cycle or requires a depot level rebuild, either of which translates to an expensive repair and a lengthy downtime for the weapon until the trunnion or, more commonly, the entire weapon can be replaced.

Barrels for belt fed machine guns and most other firearms are typically threaded and thus designed to secured to the trunnion by matingly engagement of the barrel threads with threads in the trunnion. Screw threads necessarily require rotation of the barrel in one direction during installation and the opposite direction during removal. This imparts a handedness to barrel installation and removal that can be problematic for users who may be forced to use a non-dominant hand to perform either operation, for example, due their role in a crew serving the weapon. Threaded barrels also obligate a user to take great care during installation because the breach of a barrel that is threaded too far or not far enough into the trunnion will not be properly headspaced, and improper headspacing can cause catastrophic problems when the firearm is discharged. Unfortunately, this exposes operators of such machine guns to significant risk of bodily harm and death when the demands of combat prevent a user from taking the requisite care to install the barrel. Instead, many such operators simply tighten the barrel down as much as possible and hope for the best, which runs the risk that the weapon may catastrophically malfunction or not function at all, leaving the operator exposed to enemy fire in either case.

Accordingly, what is needed are improvements in firearm trunnions and barrels.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Features of the presently disclosed invention overcome or minimize some or all of the identified deficiencies of the prior art, as will become evident to those of ordinary skill in the art after a study of the information presented in this document.

It is an object of the present invention to provide a novel multipart trunnion assembly that compartmentalizes different portions of traditional monolithic trunnions into individual components that are less challenging and costly to manufacture, and easier to replace. The novel multipart trunnion assembly includes a trunnion body configured to mount other components of the firearm and a trunnion insert configured to be releasably secured in the trunnion body. The trunnion insert defines an interior space in which a barrel of the firearm is receivable to mount the barrel to the trunnion body when the trunnion insert is secured in the trunnion body. The multipart trunnion assembly enables the use of lighter materials in the trunnion body where the strength of relatively denser alloys is not needed, resulting in a lighter firearm, and permits the use of more durable materials to form the trunnion insert, which contains all critical trunnion geometries for safe and reliable functioning of the firearm such as bolt lock up surfaces, chamber support surfaces, and barrel locking lug surfaces. The trunnion assembly also eschews the use of screw threads to mount the barrel so as to simply barrel installation and removal. The releasable trunnion insert also facilitates the use of multiple calibers in a single firearm by enabling a user to quickly and easily swap between a trunnion insert, barrel, and feed mechanism of one caliber to a trunnion insert, barrel, and feed mechanism of another caliber.

It is another object of the present invention to provide a novel ambidextrously mountable barrel assembly that simplifies barrel installation and removal by eliminating screw threads from the interface between the barrel and the trunnion, and enabling a user to mount a barrel to the trunnion of a firearm by simply inserting the barrel assembly into the trunnion and rotating a portion of the barrel assembly a predetermined amount in either direction (i.e., clockwise or counterclockwise). The barrel assembly also eliminates the risk of improper headspacing by virtue of being inherently designed to automatically headspace the barrel upon mounting to the trunnion. The barrel assembly is configured to function with the novel multipart trunnion assembly disclosed herein, as well as monolithic trunnions formed with certain of the novel internal geometries of the presently disclosed trunnion assembly discussed in more detail below (e.g., barrel locking lugs).

Numerous other objects, advantages and features of the present disclosure will be readily apparent to those of skill in the art upon a review of the following drawings and description of exemplary embodiments.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified. In the drawings, not all reference numbers are included in each drawing, for the sake of clarity.

DETAILED DESCRIPTION

The details of one or more embodiments of the present invention are set forth in this document. Modifications to embodiments described in this document, and other embodiments, will be evident to those of ordinary skill in the art after a study of the information provided herein. The information provided in this document, and particularly the specific details of the described exemplary embodiment(s), is provided primarily for clearness of understanding and no unnecessary limitations are to be understood therefrom. In case of conflict, the specification of this document, including definitions, will control.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

While the terms used herein are believed to be well understood by one of ordinary skill in the art, a number of terms are defined below to facilitate the understanding of the embodiments described herein. Unless defined otherwise, all technical and scientific terms used herein have the same meaning as commonly understood by one of ordinary skill in the art to which the subject matter disclosed herein belongs. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 1:
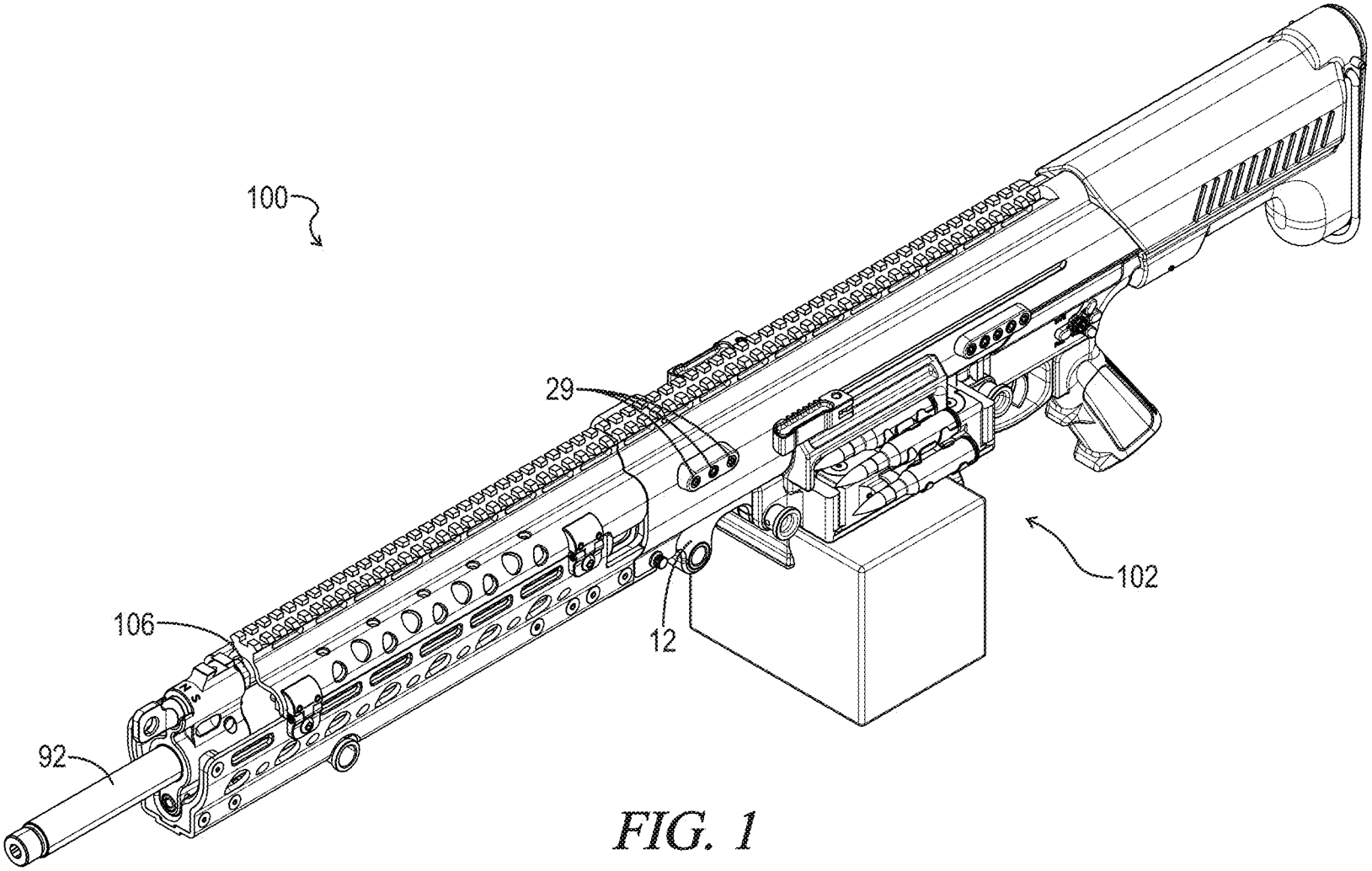
FIG. 1 is an elevated front left side perspective view of a belt fed machine gun equipped with a multipart trunnion and an ambidextrously mountable barrel formed in accordance with an embodiment of the present invention. The machine gun is depicted in battery with a cartridge chambered and the bolt locked. The barrel is depicted secured in the trunnion.

As described herein, an "upright" position is considered to be the position of apparatus components while in proper operation or in a natural resting position as described and shown herein, for example, in FIG. 1. "Vertical," "horizontal," "above," "below," "side," "top," "bottom," "upper," "lower," and other orientation terms are described with respect to this upright position during operation, unless otherwise specified, and are used to provide an orientation of embodiments of the invention to allow for proper description of example embodiments. A person of skill in the art will recognize, however, that the apparatus can assume different orientations when in use.

As used herein, the terms "front" and "forward" means in a direction extending toward the muzzle of the firearm. In some cases, the term "forward" can also mean forward beyond the muzzle of the firearm. The terms "aft" and "rear" means in a direction extending away from the muzzle of the firearm toward a rear end of a firearm. In some cases, the term "rearward" can also mean rearward beyond the rear end of the firearm.

The term "when" is used to specify orientation for relative positions of components, not as a temporal limitation of the claims or apparatus described and claimed herein unless otherwise specified.

The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments.

All measurements should be understood as being modified by the term "about" regardless of whether the word "about" precedes a given measurement.

The terms "significantly", "substantially", "approximately", "about", "relatively," or other such similar terms that may be used throughout this disclosure, including the claims, are used to describe and account for small fluctuations, such as due to variations in manufacturing or processing from a reference or parameter. Such small fluctuations include a zero fluctuation from the reference or parameter as well. For example, they can refer to less than or equal to +10%, such as less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%. In some cases, the term "substantially" as used herein means what is considered normal or possible within the limits of applicable industry-accepted manufacturing practices and tolerances.

All references to singular characteristics or limitations of the present disclosure shall include the corresponding plural characteristic(s) or limitation(s) and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

The methods and devices disclosed herein, including components thereof, can comprise, consist of, or consist essentially of the essential elements and limitations of the embodiments described herein, as well as any additional or optional components or limitations described herein or otherwise useful.

Figure 3:
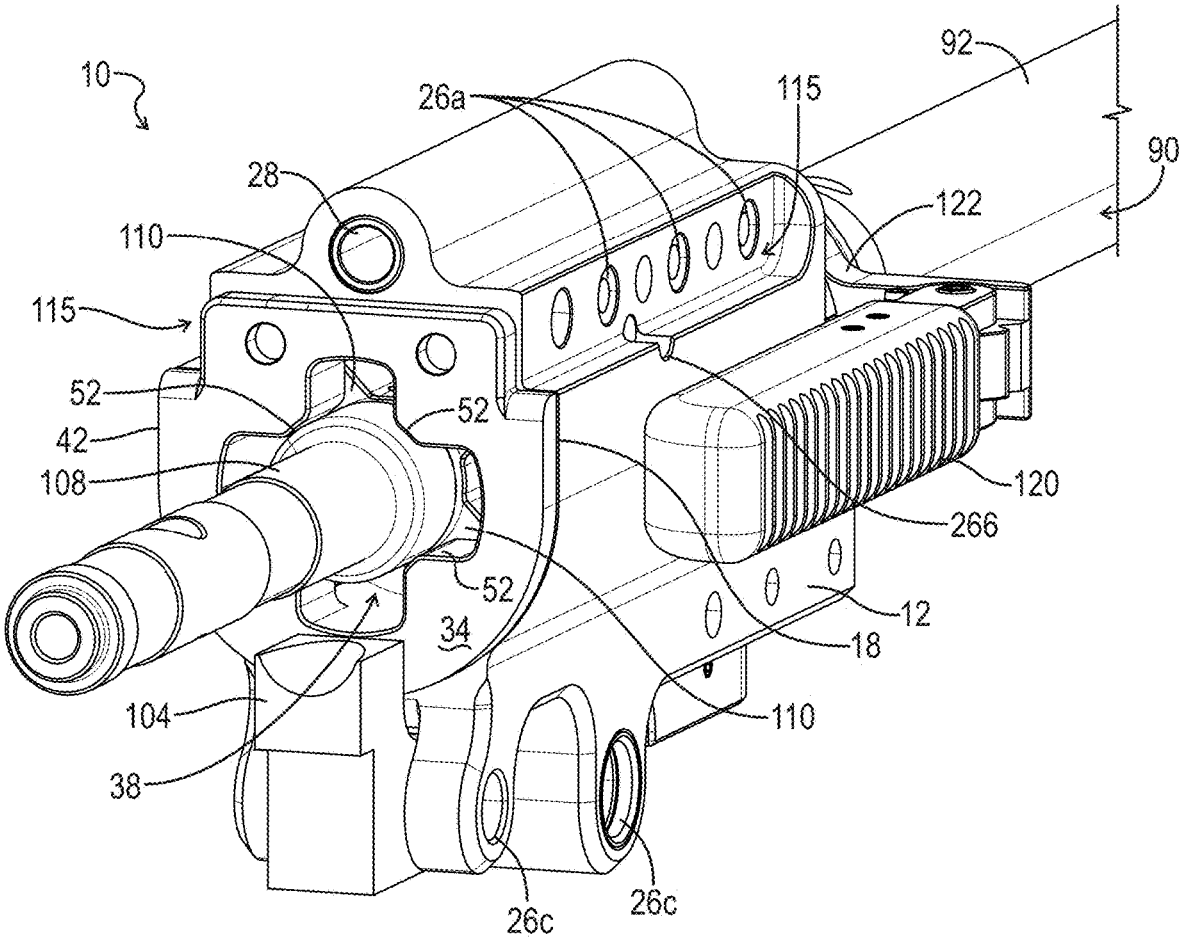
FIG. 3 is an elevated rear right side perspective view of the objects of FIG. 2. The left and right rails are omitted for clarity.
Figure 4:
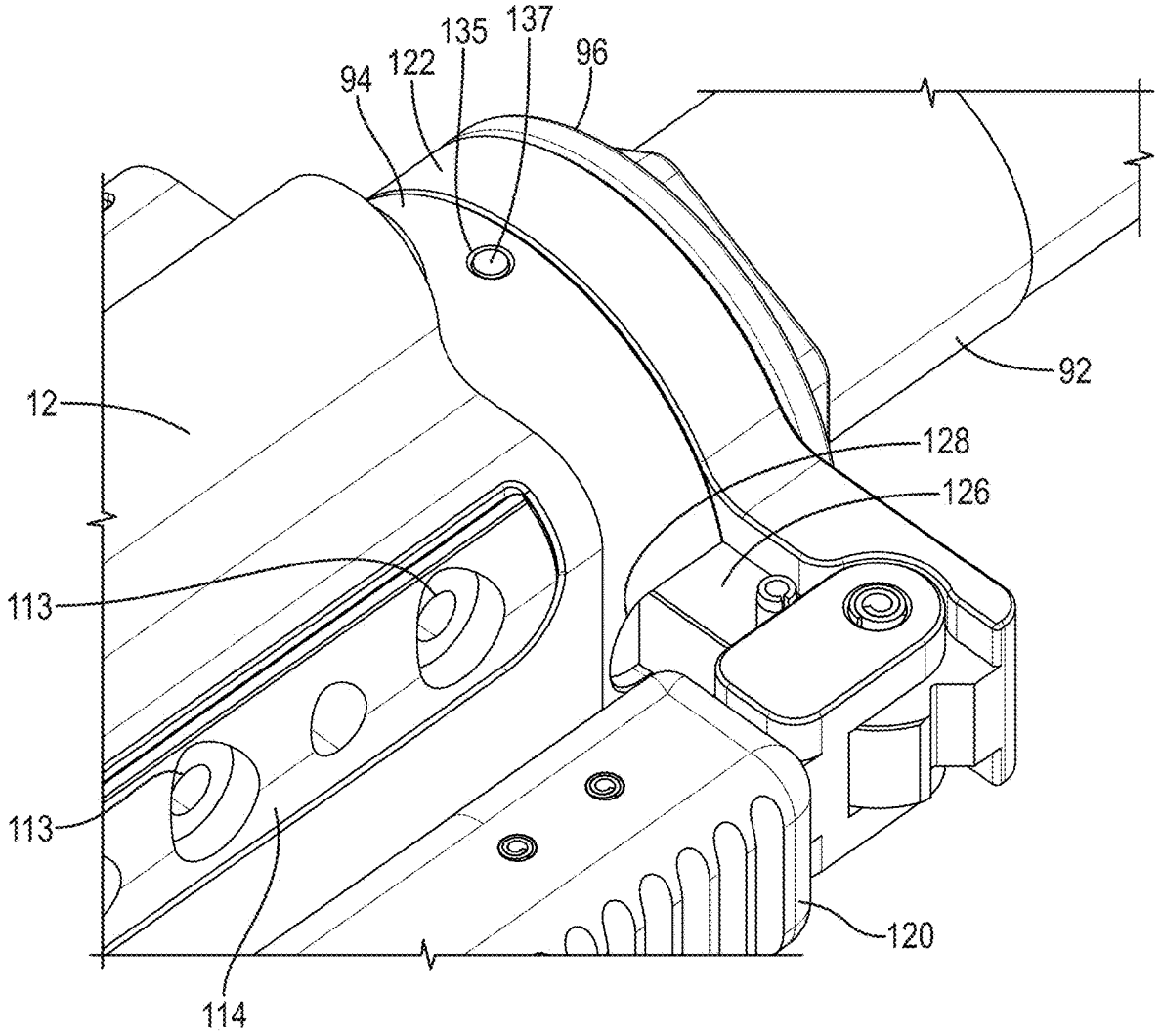
FIG. 4 an elevated right side perspective magnified detail view of the objects of FIG. 3.
Figure 5:
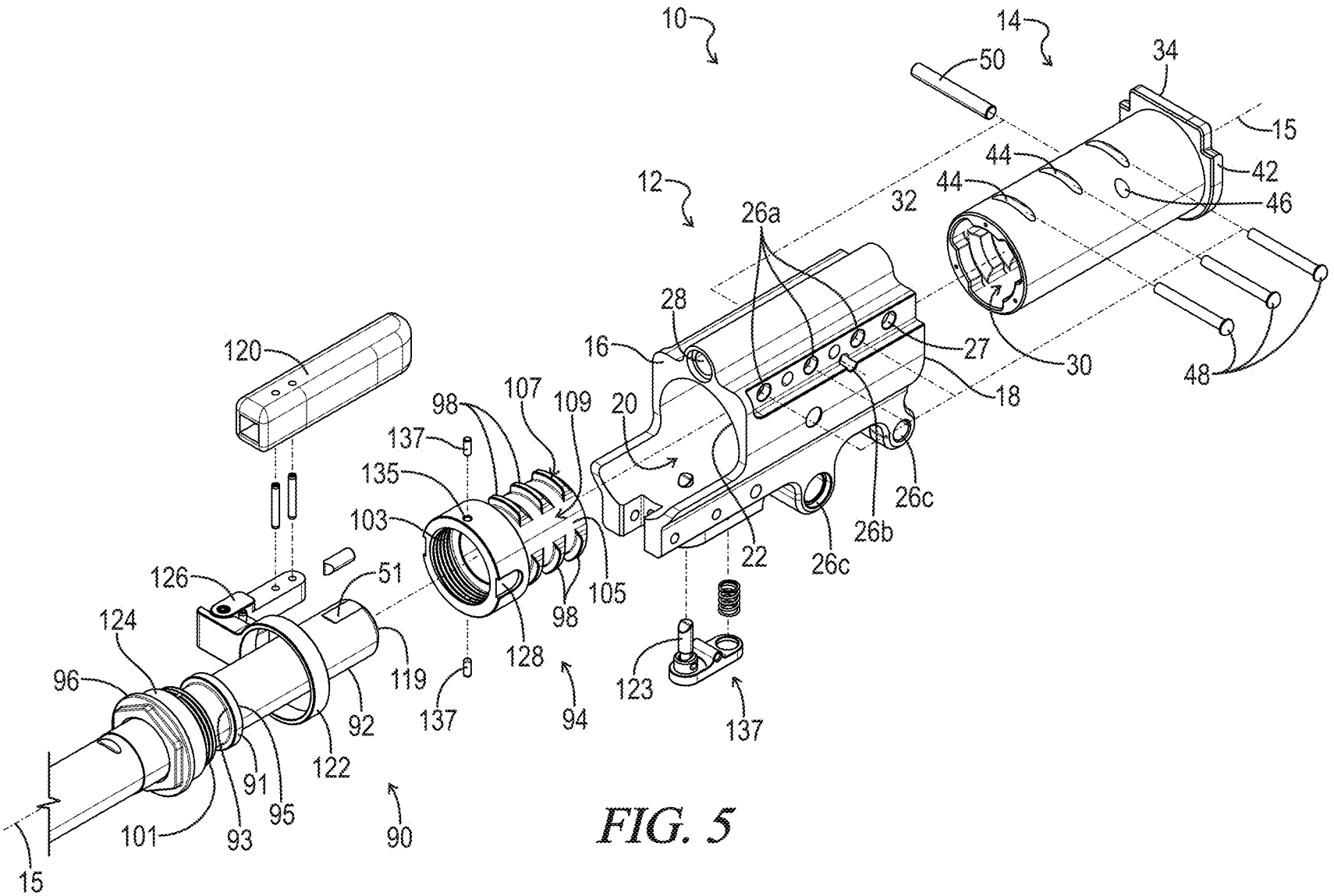
FIG. 5 is a partially exploded elevated front left side perspective view of the multipart trunnion and ambidextrously mountable barrel of FIG. 1.
Figure 6:
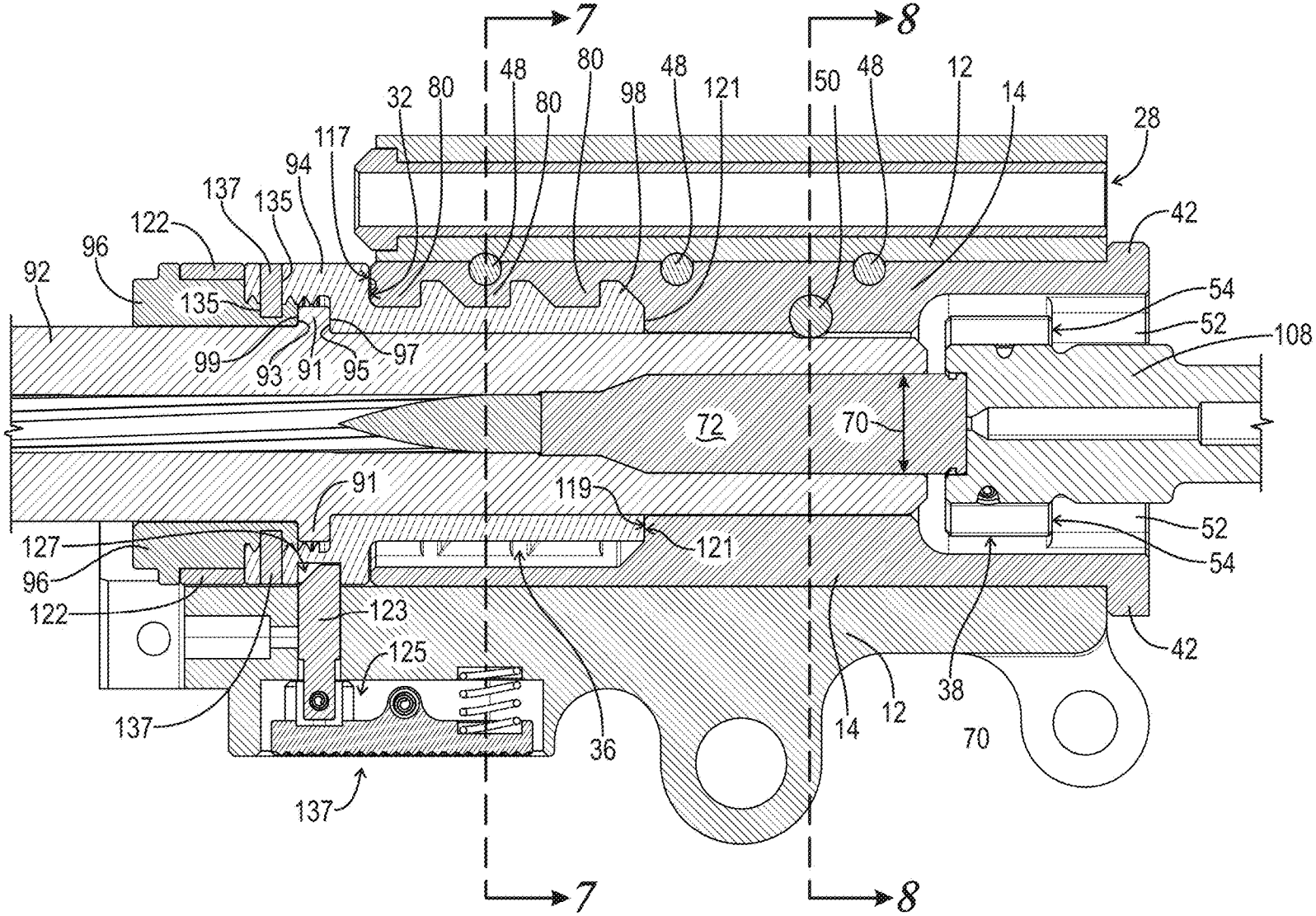
FIG. 6 is a fragmentary sectional view taken along line 6-6 of FIG. 2.
Figure 8:
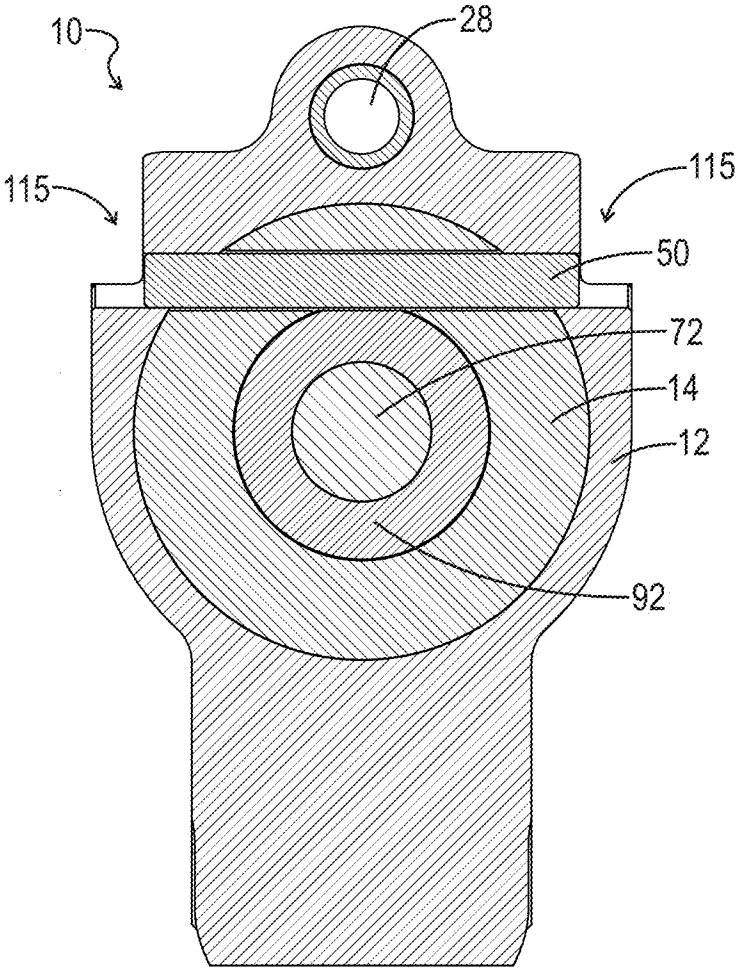
FIG. 8 is a sectional view taken along line 8-8 of FIG. 6. The rails and barrel lever are omitted for clarity.
Figure 7:
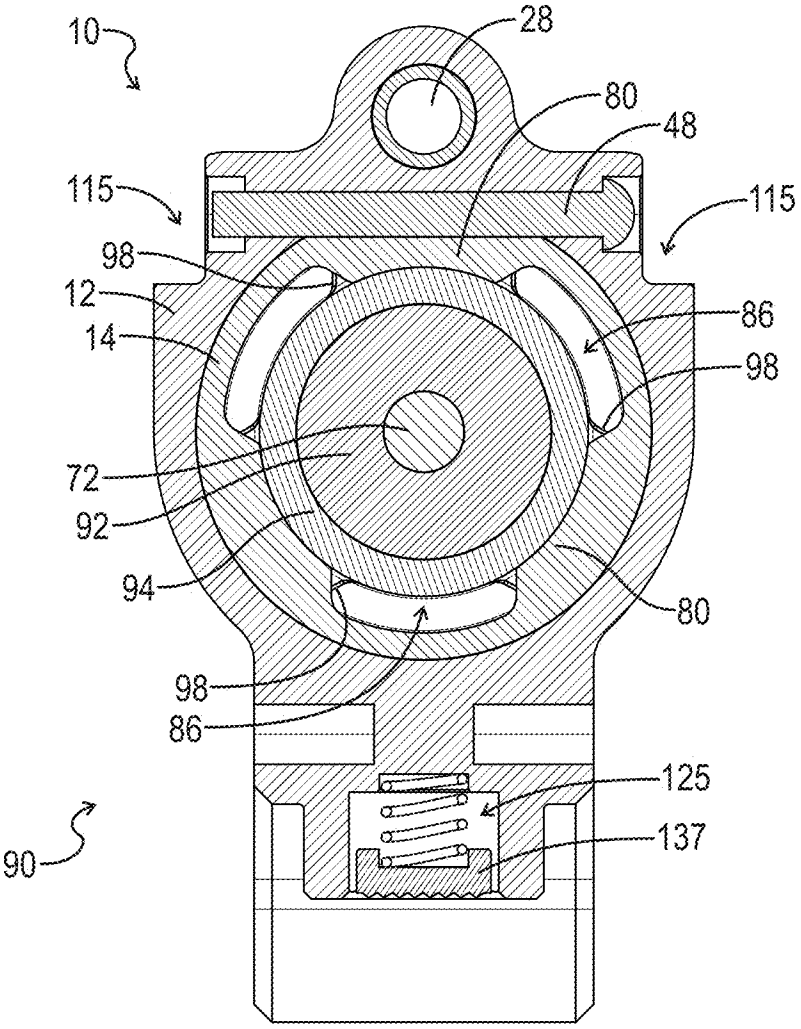
FIG. 7 is a sectional view taken along line 7-7 of FIG. 6. The rails and barrel lever are omitted for clarity.

Referring now to FIGS. 1-12, there is depicted a firearm 100 in the form of a belt fed machine gun 100 containing a multipart trunnion assembly 10 and an ambidextrous barrel assembly 90 constructed in accordance with an embodiment of the present invention. The multipart trunnion 10 includes a trunnion body 12 and a trunnion insert 14 secured within the trunnion body 12. The trunnion body 12 and the trunnion insert 14 lack screw threads. The trunnion body 12 has a front end 16, a back end 18, and a threadless aperture 20. The aperture 20 defines a longitudinal axis 15 of the firearm 100. The aperture 20 extends longitudinally through the trunnion body 12 along the axis 15 from the front end 16 to the back end 18 of the trunnion body 12. As such, the aperture 20 has a front end 22 and a back end 24. The trunnion body 12 defines a plurality of through holes extending therethrough. The through holes extend through the trunnion body 12 at an angle transverse to the axis 15. In one embodiment, three through holes 26*a* can be spaced longitudinally in a row extending along the trunnion body 12. The row of longitudinally spaced through holes 26*a* can extend along the trunnion body 12 parallel to the axis 15. The three through holes 26*a* can partially intersect the aperture 20 of the trunnion body 12, as best shown in FIGS. 5-7. One through hole 26*b* can be spaced below the row of three through holes 26*a*. The one through hole 26*b* completely intersects the aperture 20, as best shown in FIGS. 5-6 and 8.

The trunnion body 12 includes protruding lobes defining additional through holes 26*c* through which fasteners (not visible) are receivable to mount certain components of the firearm 100 thereon, including a feed mechanism 102 with feed ramp 104, a removable support structure such as a bipod (not shown). The trunnion body 12 also defines an elongated hole 28 in which the piston system 106 of the firearm 100 is partially housed. The trunnion body 12 further defines a pair of elongated pockets 115 and a plurality of threaded holes 27 spaced longitudinally from the through holes 26*a* on each side of the trunnion body 12 along the pockets 115. Each threaded hole 27 is configured to receive a threaded fastener 29. The threaded fasteners 29 are configured to mount left and right side rails 112, 114 in the pockets 115 on the trunnion body 12.

The trunnion insert 14 is configured to be secured in the aperture 20 of the trunnion body 12. The trunnion insert 14 defines a threadless interior space 30 in which the barrel assembly 90 of the firearm 100 is receivable to mount a threadless barrel 92 to the trunnion body 12 when the trunnion insert 14 is secured in the aperture 20 of the trunnion body 12. The trunnion insert 14 defines a longitudinal axis 15 that is coaxial with the axis 15 defined by the trunnion body 12 when the trunnion insert 14 is received in the trunnion body 12. The trunnion insert 14 can be a tubular body 14 having a forward end 32 and a rear end 34. However, in other embodiments, the trunnion insert 14 can have a non-tubular shape or a non-circular cross section. The interior space 30 can extend longitudinally through the trunnion insert 14 along the axis 15. The interior space 30 includes an open forward end 36, an open rear end 38, and a passage 40. The passage 40 extends from the open forward end 36 to the open rear end 38. The open forward end 36 is configured to receive the barrel 92 therethrough and into the passage 40. The open rear end 38 is configured to receive a bolt 108 of the firearm 100.

In some embodiments, the trunnion insert 14 can be configured to be receivable in the aperture 20 of the trunnion body 12 only when inserted through the back end 24 of the aperture 20. In some such embodiments, a flange 42 can extend radially outward from the rear end 34 of the trunnion insert 14. The flange 42 can contact the back end 18 of the trunnion body 12 to limit how far the trunnion insert 14 can be received into the aperture 20 of the trunnion body 12, as shown in FIGS. 3 and 6. In other embodiments, the trunnion insert 14 can be configured to be receivable in the aperture 20 of the trunnion body 12 when inserted through the front end 22 of the aperture 20. In some such embodiments, a flange can extend radially outward from the forward end 32 of the trunnion insert 14. In some embodiments, the flange 42 can be omitted.

The trunnion insert 14 defines a plurality of openings 44 and a hole 46. The openings can be open-sided slots or grooves as illustrated in FIGS. 5-6, or closed-sided bores. The openings 44 are spaced longitudinally in a row extending along the trunnion insert 14 parallel to the axis 15. The hole 46 is spaced below the row of openings 44. The openings 44 can extend through the insert 14 without intersecting the interior space 30, as best shown in FIGS. 5-7 and 9. The openings 44 can extend across a top of the insert 14 transverse to the axis 15. In one embodiment, the insert 14 can include three openings 44. The hole 46 extends through the insert 14 transverse to the axis 15. The hole 46 at least partially intersects the passage 40, as best shown in FIGS. 6 and 8.

The longitudinally spaced through holes 26*a* in the trunnion body 12 align with the openings 44 in the trunnion insert 14 when the trunnion insert 14 is received in the aperture 20 of the trunnion body 12. In some embodiments, the longitudinally spaced through holes 26*a* in the trunnion body 12 align with the openings 44 in the trunnion insert 14 when the trunnion insert 14 is received in the aperture 20 of the trunnion body 12 with the flange 42 in contact with the back end 18 of the trunnion body 12. In other embodiments, the through holes 26*a* can align with the openings 44 when the trunnion insert 14 is received in the aperture 20 of the trunnion body 12 with the flange 42 in contact with the front end 16 of the trunnion body 12. Similarly, the through hole 26*b* in the trunnion body 12 aligns with the hole 46 in the trunnion insert 14 when the trunnion insert 14 is received in the aperture 20 of the trunnion body 12. In some embodiments, the through hole 26*b* in the trunnion body 12 aligns with the hole 46 in the trunnion insert 14 when the trunnion insert 14 is received in the aperture 20 of the trunnion body 12 with the flange 42 in contact with the back end 18 of the trunnion body 12. In other embodiments, the through hole 26*b* in the trunnion body 12 aligns with the hole 46 in the trunnion insert 14 when the trunnion insert 14 is received in the aperture 20 of the trunnion body 12 with the flange 42 in contact with the front end 16 of the trunnion body 12. In this way, the flange 42 can be configured to index the trunnion insert 14 within the aperture 20 of the trunnion body 12.

A plurality of trunnion insert fasteners 48 are receivable through the respective through holes 26*a* in the trunnion body 12 and the openings 44 of the trunnion insert 14 when the trunnion insert 14 is received in the aperture 20 and the through holes 26*a* are aligned with the openings 44 in order to secure the trunnion insert 14 in the trunnion body 12. In one embodiment, the trunnion insert fasteners 48 can be rivets. In another embodiment, the trunnion insert fasteners 48 can be dowel pins. In other embodiments, the trunnion insert fasteners 48 can be threaded fasteners.

A barrel fastener 50 is receivable through the through hole 26*b* in the trunnion body 12 and the hole 46 in the trunnion insert 14 when the trunnion insert 14 is received in the aperture 20 and the through hole 26*b* is aligned with the hole 46 to secure the trunnion insert 14 in the trunnion body 12 and substantially prevent the barrel 92 from rotating in the passage 40. The barrel fastener 50 prevents the barrel 92 from rotating when the barrel fastener 50 secures the trunnion insert 14 in the aperture 20 of the trunnion body 12 by engaging a surface 51 of the barrel 92 when the barrel 92 is received in the passage 40 of the trunnion insert 14. In one embodiment, the surface 51 of the barrel 92 engaged by the barrel fastener 50 is a flat surface 51, as best shown in FIGS. 5-6 and 8. The barrel fastener 50 can extend across and engage the entire width of the flat surface 51 to prevent the barrel 92 from rotating in either the clockwise or counterclockwise direction around the axis 15. In one embodiment, the barrel fastener 50 can be a dowel pin. In another embodiment, the barrel fastener 50 can be a threaded fastener.

The trunnion insert 14 can be secured to the trunnion body 12 by the barrel fastener 50 alone, by the trunnion insert fasteners 48 alone, or by the barrel fastener 50 in combination with the trunnion insert fasteners 48 as shown in the figures. In other embodiments, the trunnion insert 14 can be secured within the trunnion body 12 via threaded fasteners such as bolts or screws, an adhesive, welds, or the like. However, it is believed that use of such fasteners as rivets, dowel pins, and threaded fasteners provide the trunnion assembly 10 with the necessary strength to endure sustained automatic fire while also facilitating easy release and removal of the trunnion insert 14 from the trunnion body 12 when necessary or desirable for maintenance, repair, replacement, or a change in firearm caliber.

Figure 2:
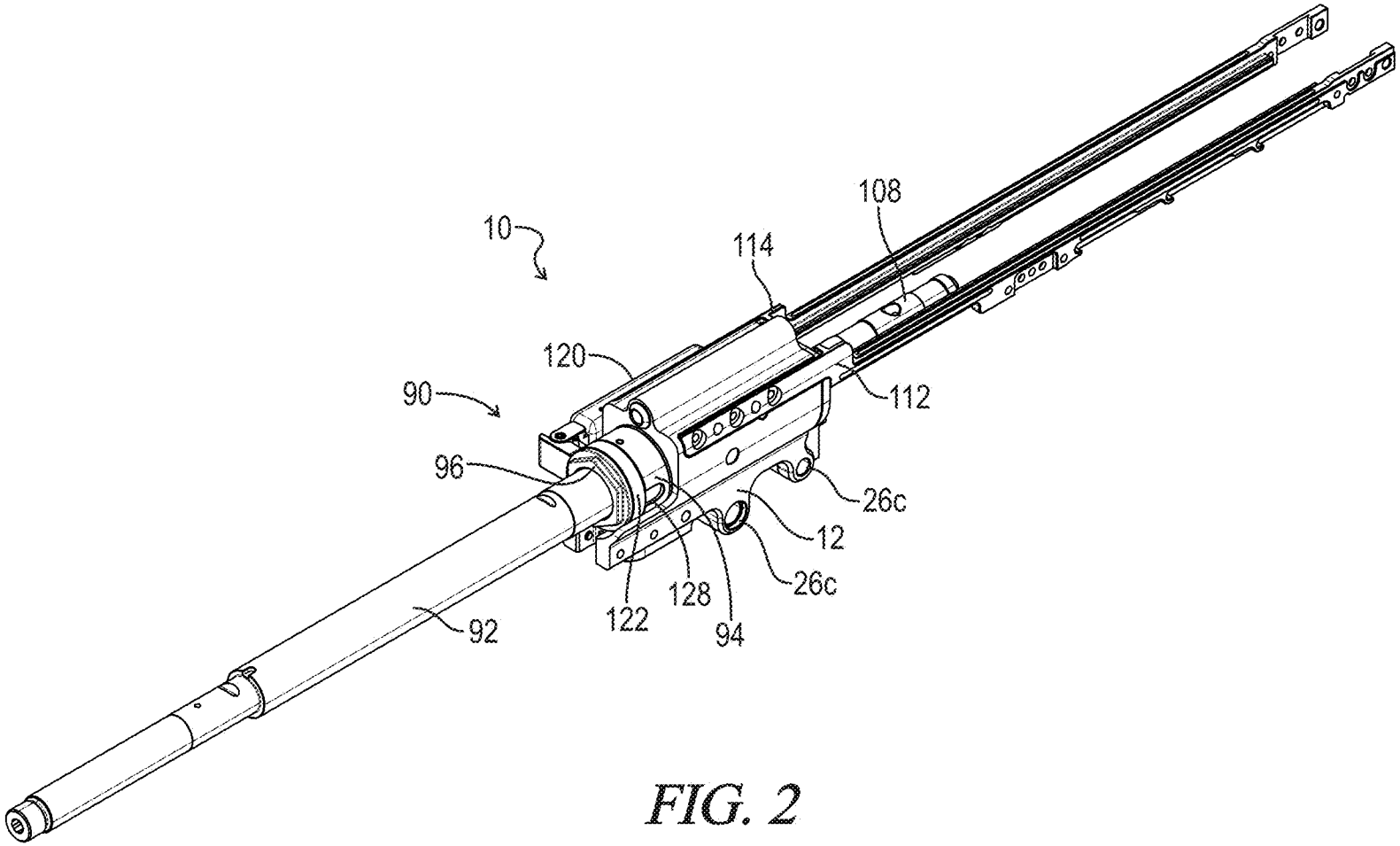
FIG. 2 is another elevated front left side perspective view of the machine gun of FIG. 1 with the handguard, housing, gas block, piston, feed mechanism, grip, and buttstock assemblies omitted to better show the multipart trunnion and ambidextrously mountable barrel.

As shown in FIGS. 1-3, the left and right side rails 112, 114 are releasably mountable to the trunnion body 12 over the through holes 26*a*, 26*b*, the trunnion insert fasteners 48, and the barrel fastener 50. The side rails 112, 114 are receivable in corresponding elongated pockets 115 defined in the sides of the trunnion body 12. The threaded fasteners 29 are receivable in the threaded holes 27 of the trunnion body 12 through the clearance holes 113 in the rails 112, 114. This can further secure the fasteners 48, 50 in their respective through holes 26*a*, 26*b* and prevent the fasteners 48, 50 from becoming unintentionally dislodged from the trunnion assembly 10 during firearm use.

Referring now to FIGS. 3, 6, and 9-10, the open rear end 38 of the trunnion insert 14 is configured to receive the bolt 108 of the firearm 100. The bolt 108 can have one or more bolt lugs 110 thereon. As such, the open rear end 38 of the trunnion insert 14 can include one or more bolt locking lugs 52. The bolt locking lugs 52 are spaced around the open rear end 38 of the trunnion insert 14. Each bolt locking lug 52 defines a locking surface 54. Each locking surface 54 is configured to engage a bolt lug 110 when the bolt 108 is in battery in the open rear end 38 of the trunnion insert 14, as best shown in FIG. 6.

Figure 11:
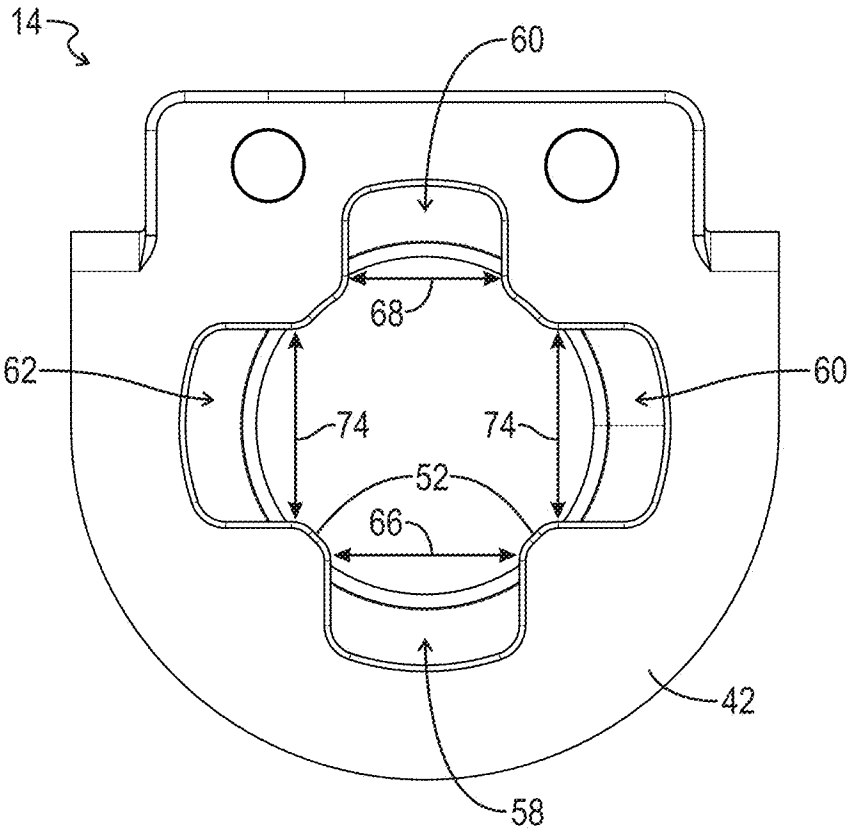
FIG. 11 is a rear elevational view of the trunnion insert of FIG. 10.

As best shown in FIG. 11, the bolt locking lugs 52 can define a plurality of bolt lug gaps 56. Each bolt lug gap 56 is defined between two adjacent bolt locking lugs 52. The plurality of bolt lug gaps 56 can include a lower gap 58, an upper gap 60, a left gap 62, and a right gap 64. The lower gap 58 can have a width 66 greater than a width 68 of the upper gap 60. The width 66 of the lower gap 58 can be larger than the diameter 70 of a cartridge 72 receivable in the barrel 92 in order to allow the bolt 108 to push a large caliber cartridge 72 through the open rear end 38 of the trunnion insert 14 and into the chamber. In one embodiment, the cartridge can be a .338 Norma Magnum cartridge 72. In other embodiments, the cartridge can be a different caliber. In some embodiments, the cartridge diameter 70 can be greater than a diameter of the bolt 108.

In some embodiments, the width 68 of the upper gap 60 can be smaller than the width 66 of the lower gap 58. This can prevent user confusion during assembly or repair of the firearm 100 by ensuring that the bolt 108 can only enter the open rear end 38 of the trunnion insert 14 when the trunnion insert 14 is secured into the trunnion body 12 in the proper configuration. In some embodiments, the left gap 62 and the right gap 64 can have a width 74 that is greater than the width 66 of the lower gap 58. The width 74 of the left and right gaps 62, 64 can be substantially identical so as to facilitate ambidextrous use of the bolt 108 (including ejection to either side) when the firearm 100 is placed in a right-handed configuration for a right-handed shooter or a left-handed configuration for a left-handed shooter.

Figure 9:
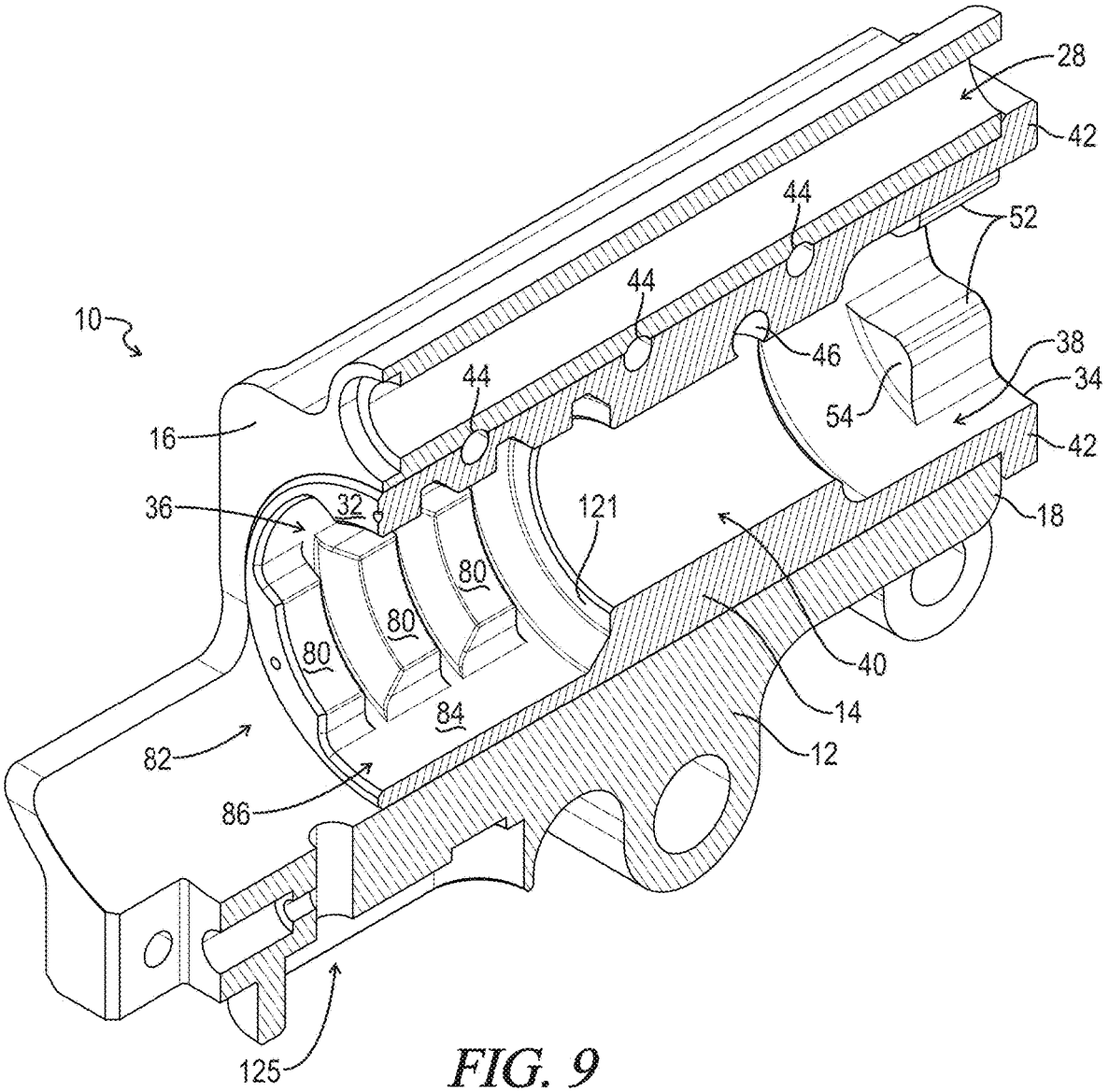
FIG. 9 is a perspective sectional view of the multipart trunnion taken vertically along the longitudinal axis of FIG. 5. The trunnion insert fasteners and barrel fastener are omitted for clarity.
Figure 10:
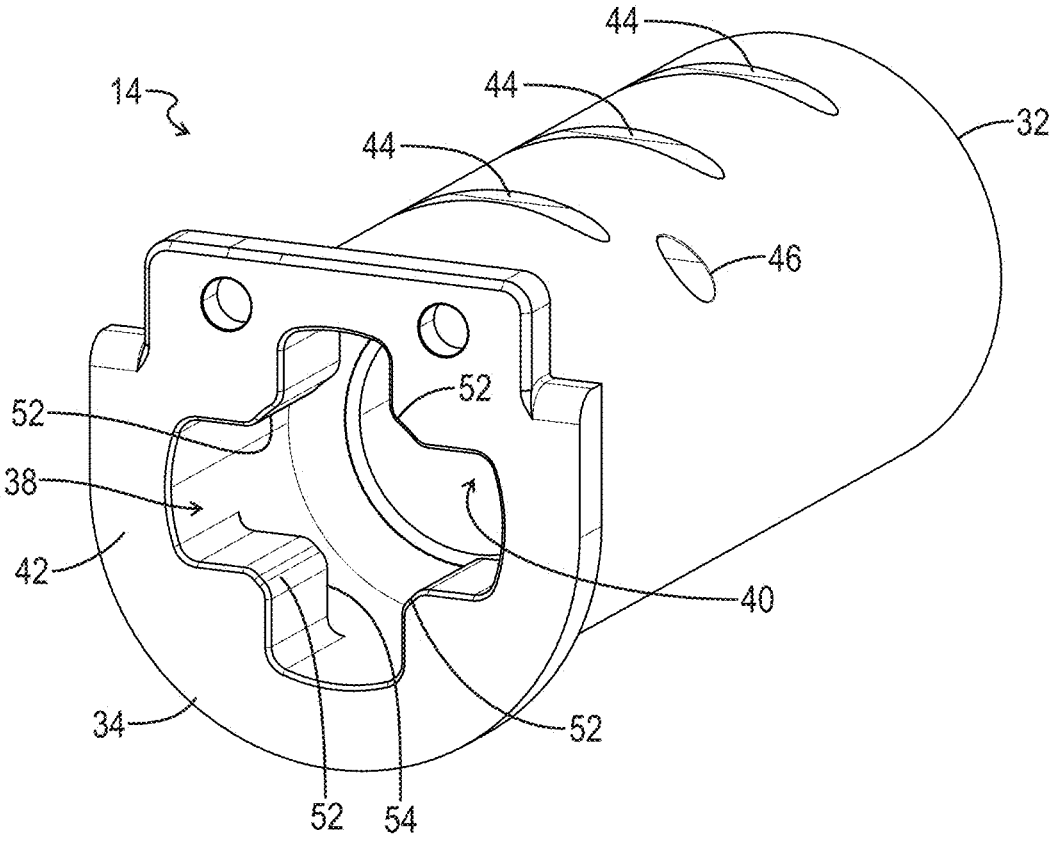
FIG. 10 is an elevated rear right side perspective of the trunnion insert of FIG. 5.
Figure 12:
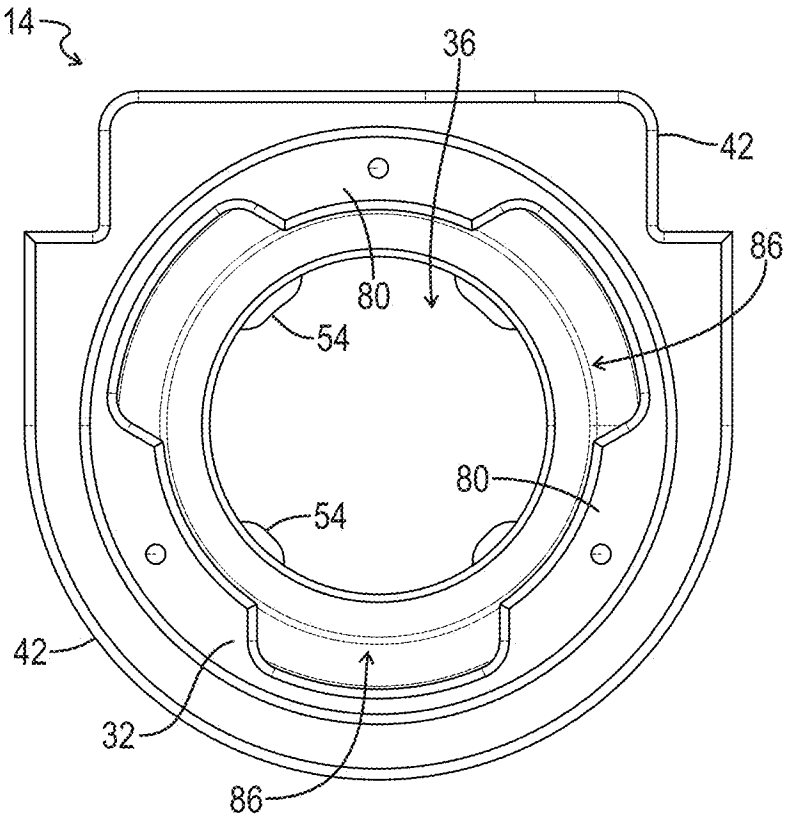
FIG. 12 is a front elevational view of the trunnion insert of FIG. 10.

Referring now to FIGS. 5-6 and 9, the trunnion assembly 10 is configured to mount the barrel assembly 90. More specifically, the open forward end 36 of the trunnion insert 14 is configured to mount the barrel assembly 90 to the firearm 100. In some embodiments, the open forward end 36 of the trunnion insert 14 includes a plurality of barrel locking lugs 80. The barrel locking lugs 80 are non-helical. The barrel locking lugs 80 can be arranged in one or more longitudinally extending rows 82. Each barrel locking lug 80 in a row 82 is longitudinally spaced from each preceding or subsequent lug 80. Each row of longitudinally spaced barrel locking lugs 80 extends along the interior surface 84 of the open forward end 36 parallel to the axis 15. Each row 82 of barrel locking lugs 80 can be spaced circumferentially around an interior surface 84 of the open forward end 36 from each adjacent row 82 so as to define a keyway 86 extending longitudinally along the interior surface 84 between each adjacent row 82 of barrel locking lugs 80.

As best shown in FIGS. 5-6, the barrel assembly 90 can include a barrel 92, a barrel lug sleeve 94, and a barrel lug cap 96. The barrel 92 defines an axis 15 and an annular protrusion 91 having a front face 93 and a rear face 95. The barrel axis 15 is coaxial with the axis 15 of trunnion body 12 and the axis 15 of the trunnion insert 14 when the trunnion insert 14 is received in the aperture 20 of the trunnion body 14 and the barrel 92 is received in the passage 40 of the trunnion insert 14. The barrel 92 does not include screw threads. The barrel lug sleeve 94 can define a shoulder 97 configured to be received against the annular protrusion 91. In some embodiments, the barrel lug sleeve 94 can define a shoulder 97 configured to be received against the rear face 95 of the annular protrusion 91. Similarly, the barrel lug cap 96 can define a surface 99 configured to be received against the annular protrusion 91. In some embodiments, the barrel lug cap 96 can define a surface 99 configured to be received against the front face 93 of the annular protrusion 91. As such, in some embodiments, the barrel lug sleeve 94 can be shaped and sized to be secured to the annular protrusion 91 when the shoulder 97 of the barrel lug sleeve 94 is received against one face of the annular protrusion 91 and the surface 99 of the barrel lug cap 96 is received against the other face of the annular protrusion 91. The surface 99 of the barrel lug cap 96 is configured to slide around the corresponding face of the annular protrusion 91 when the barrel lug sleeve 94 and the barrel lug cap 96 are secured to the protrusion 91 so that the barrel lug cap 96 can be rotated around the barrel 92.

The barrel lug cap 96 includes a set of screw threads 101 configured to matingly engage a set of screw threads 103 on the barrel lug sleeve 94. The barrel lug sleeve 94 can be secured to the barrel 92 by matingly engaging the respective sets of screw threads 101, 103 about the annular protrusion 91. In some embodiments, the barrel lug cap 96 can include a set of external screw threads 101 configured to matingly engage a corresponding set of internal screw threads 103 on the barrel lug sleeve 94. In other embodiments, the barrel lug cap 96 can include a set of internal screw threads (not shown) configured to matingly engage a corresponding set of external screw threads (not shown) on the barrel lug sleeve 94. In some embodiments, screw threads 101, 103 can be the only screw threads on the barrel assembly 90. In some embodiments, no surface of the barrel assembly 90 that contacts any surface of the trunnion 10 includes screw threads.

In some embodiments, the barrel assembly 90 can further include one or more fasteners and corresponding apertures to further secure the barrel lug sleeve 94 to the barrel 92. For example, as best shown in FIGS. 4-6, the barrel lug sleeve 94 and barrel lug cap 96 can include a plurality of apertures 135 arranged to coaxially align when the respective sets of screw threads 101, 103 are matingly engaged about the annular protrusion 91 as described above. A fastener 137 is receivable in each pair of aligned apertures 135 to prevent the barrel lug sleeve 94 and barrel lug cap 96 from becoming disengaged. The fasteners 137 can be pins, screws, or the like.

The barrel lug sleeve 94 includes a plurality of barrel lugs 98. The barrel lugs 98 are non-helical. The barrel lugs 98 are on an exterior surface 105 of the barrel lug sleeve 94. The barrel lugs 98 are arranged in one or more longitudinally extending rows 107. Each barrel lug 98 in a row 107 is longitudinally spaced from each preceding or subsequent lug 98. Each row 107 of longitudinally spaced barrel lugs 98 can extend along the exterior surface 105 of the barrel lug sleeve 94 parallel to the barrel axis 15 when the barrel lug sleeve 94 is secured to the barrel 92. Each row 107 of barrel lugs 98 can be spaced circumferentially around the exterior surface 105 of the barrel lug sleeve 94 from each adjacent row 107 so as to define a keyway 109 extending longitudinally along exterior surface 105 between each adjacent row 107 of barrel lugs 98.

The assembled barrel assembly 90 is mountable to the trunnion assembly 10 by inserting the barrel lug sleeve 94 into the open forward end 36 of the trunnion insert 14 with the one or more rows 107 of barrel lugs 98 on the barrel lug sleeve 94 aligned with the corresponding keyway(s) 36 of the trunnion insert 14, and the one or more rows 82 of barrel locking lugs 80 on the trunnion insert 14 likewise aligned with the corresponding keyway(s) 109 on the barrel lug sleeve 94. In the depicted embodiment, the rows 107 of barrel lugs 98 pass through the keyways 36 of the trunnion insert 14 and the rows 82 of barrel locking lugs 80 pass through the keyways 109 on the barrel lug sleeve 94 during insertion of the barrel lug sleeve 94 into the open forward end 36 of the trunnion insert 14. With lug rows and keyways aligned, the barrel lug sleeve 94 is inserted through the open forward end 36 of the trunnion insert 14 until a shoulder 117 of the barrel lug sleeve 94 contacts the forward end 32 of the trunnion insert 14 and the rearmost end 119 of the barrel lug sleeve 94 contacts a shoulder 121 of the trunnion insert 14. The barrel lug sleeve 94 can be shaped and sized so that shoulder 117 contacts forward end 32 at the same time that rearmost end 119 contacts shoulder 121.

When the barrel lug sleeve 94 is received in the open forward end 36 of the trunnion insert 14 with shoulder 117 contacting forward end 32 and rearmost end 119 contacting shoulder 121, the barrel lug sleeve 94 can be rotated in either a clockwise or counterclockwise about axis 15 to engage the barrel lugs 98 with the barrel locking lugs 80, as best shown in FIG. 6. A plunger 123, which can part of a spring-loaded and button activated quick release mechanism 137 mounted to the trunnion body 12, is then receivable through a cavity 125 in the bottom of the trunnion body 12 and into an orifice 127 formed in the barrel lug sleeve 94 to prevent the lug sleeve 94 from inadvertently rotating the barrel lugs 98 out of engagement with the barrel locking lugs 80.

The annular protrusion 91 is spaced from the breech 119 of the barrel 92 so that the barrel 92 is received in the passage 40 with the breech 119 properly headspaced in the trunnion assembly 10 when the barrel lugs 98 are engaged with the barrel locking lugs 80. Abutment of the shoulder 117 of the barrel lug sleeve 94 with the forward end 32 of the trunnion insert 14, and of the rearmost end 119 of the barrel lug sleeve 94 with the shoulder 121 of the trunnion insert 14 advantageously ensures proper headspacing as well as assists the flange 42 and trunnion insert fasteners 48 in preventing the trunnion insert 14 from being pushed forwardly through the aperture 20 of the trunnion body 12 during operation or use of the firearm 100.

Referring now to FIGS. 3-5, in some embodiments, the barrel assembly 90 can further include a handle or lever 120 configured to facilitate rotation of the barrel lug sleeve 94 in the trunnion assembly 10. The lever 120 is secured to a collar 122. The collar 122 rides in a recess 124 formed on the barrel lug cap 96. The collar 122 rides in the recess 124 adjacent the barrel lug sleeve 94. The collar 122 defines a protrusion 126 which is receivable in a recess 128 on the barrel lug sleeve 94. Rotation of the lever 122 in either direction about the axis 15 causes the protrusion 126 to engage a sidewall of the recess 128 and thereby rotate the barrel lug sleeve 94 about the barrel 92 within the open forward end 36 of the trunnion insert 14 so as to selectably engage or disengage the barrel lugs 98 from the barrel locking lugs 80. The lever 122 thus provides a mechanical advantage to rotate the barrel lug sleeve 94. A second identical recess 128 is formed in the opposite side of the barrel lug sleeve 94 to facilitate ambidextrous rotation of the barrel lug sleeve 94, via the lever 120, in either the clockwise or counterclockwise direction, depending on a user's handedness.

Notably, neither the trunnion insert 14 nor the barrel 92 include screw threads as the barrel assembly 90 is not threadingly connected to the trunnion assembly 10 because, as described above, screw threads impart an undesirable handedness and unnecessarily high degree of fine motor skill to barrel installation and removal. Instead, the system of locking lugs and in some embodiments, keyways, disclosed herein advantageously enable a user to mount the barrel assembly 90 to the trunnion assembly 10 by rotating the lever 122 in either direction (from vertical) about the barrel 92 until the handle can rotate no farther. As such, this system requires no careful calibration to properly headspace the weapon as do some currently available belt fed machine gun barrel systems (e.g., M240s).

The trunnion body 12 can be formed of any suitable material, but in some embodiments, the trunnion body 12 is machined from titanium to reduce the overall weight of the trunnion assembly 10 compared to traditional monolithic trunnions while providing comparable strength. The trunnion insert 14 can be formed of any suitable material, but in some embodiments, the trunnion insert 14 is machined from steel to increase strength and durability of critical geometries contained within the trunnion insert 14. In some embodiments, the trunnion insert 14 can be machined on a Swiss lathe to increase manufacturing throughput and consistency of critical geometries, while simultaneously reducing manufacturing cost per unit.

Although embodiments of the present invention have been described in detail, it will be understood by those skilled in the art that various modifications can be made therein without departing from the spirit and scope of the invention as set forth in the appended claims. For example, it should be understood that the novel ambidextrously mountable barrel assembly 90 is mountable to a monolithic trunnion (not shown) formed with the same arrangement of barrel locking lugs 80 and other geometries described above with respect to the trunnion assembly 10.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific apparatus and methods described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention, it is not intended that such references be construed as limitations upon the scope of this invention except as set forth in the following claims.

What is claimed is:

1. A trunnion assembly for a firearm, comprising:

a trunnion body defining an aperture extending therethrough;

a trunnion insert configured to be secured in the aperture, the trunnion insert defining a longitudinal axis, at least one opening extending therethrough at an angle to the axis, and an interior space in which a barrel of the firearm is receivable to mount the barrel to the trunnion body when the trunnion insert is secured in the aperture wherein the trunnion body defines at least one through hole extending therethrough which aligns with the at least one opening extending through the trunnion insert when the trunnion insert is received in the aperture of the trunnion body; and at least one trunnion insert fastener receivable in the at least one opening and the at least one through hole to secure the trunnion insert in the trunnion body when the trunnion insert is received in the aperture and the at least one opening is aligned with the at least one through hole.

2. The trunnion assembly of claim 1, wherein:

the interior space extends through the trunnion insert and includes an open forward end, an open rear end, and a passage extending from the open forward end to the open rear end;

the open rear end is configured to receive a bolt of the firearm; and the open forward end is configured to receive the barrel therethrough and into the passage.

3. The trunnion assembly of claim 2, further comprising:

at least one barrel fastener receivable through the trunnion body and the trunnion insert when the trunnion insert is received in the aperture to secure the trunnion insert in the trunnion body and substantially prevent the barrel from rotating when the barrel is received in the passage.

4. The trunnion assembly of claim 3, further comprising the barrel, wherein:

the barrel defines a flat surface configured to be engaged by the at least one barrel fastener when the barrel is received in the passage of the trunnion insert; and the at least one barrel fastener engages the flat surface to substantially prevent the barrel from rotating in the passage when the at least one barrel fastener secures the trunnion insert in the aperture of the trunnion body.

5. The trunnion assembly of claim 3, wherein:

the trunnion insert defines at least one hole extending therethrough at an angle to the axis;

the trunnion body defines at least one through hole extending therethrough which aligns with the at least one hole extending through the trunnion insert when the trunnion insert is received in the aperture of the trunnion body; and the at least one barrel fastener is receivable in the respective holes of the trunnion insert and trunnion body when the trunnion insert is received in the aperture and the at least one hole extending through the trunnion insert is aligned with the at least one through hole extending through the trunnion body to secure the trunnion insert in the trunnion body and substantially prevent the barrel from rotating when the barrel is received in the passage.

6. The trunnion assembly of claim 2, wherein:

the bolt includes at least one bolt lug thereon; and the open rear end of the trunnion insert includes at least one locking surface configured to engage the at least one bolt lug when the bolt is in battery in the open rear end of the trunnion insert.

7. The trunnion assembly of claim 2, wherein:

the trunnion insert includes first and second pluralities of non-helical, axially spaced barrel locking lugs, each plurality of barrel locking lugs spaced circumferentially around an interior surface of the open forward end of the trunnion insert from the other plurality of barrel locking lugs so as to define at least one keyway extending longitudinally along the interior surface between the first and second pluralities of barrel locking lugs.

8. The trunnion assembly of claim 1, wherein:

the aperture of the trunnion body includes a front end and a back end; and the trunnion insert is configured to be receivable in the aperture only when inserted into the aperture through the front end or the back end thereof.

9. The trunnion assembly of claim 8, wherein:

the trunnion insert includes a tubular body having a forward end, a rear end, and a flange extending radially outward from the forward end or the rear end; and the flange is configured to index the trunnion insert within the aperture by engaging a surface of the trunnion body at the front end or the back end of the aperture.

10. The trunnion assembly of claim 1, wherein:

the aperture of the trunnion body includes a front end and a back end; and the trunnion insert is configured to be receivable in the aperture only when inserted into the aperture through the back end thereof.

11. The trunnion assembly of claim 10, wherein:

the trunnion insert includes a tubular body having a forward end, a rear end, and a flange extending radially outward from the rear end; and the flange is configured to index the trunnion insert within the aperture by engaging a surface of the trunnion body at the back end of the aperture.

12. The trunnion assembly of claim 1, wherein the trunnion body is configured to mount a feed mechanism of the firearm.

13. The trunnion assembly of claim 1, wherein the trunnion body and the trunnion insert lack screw threads.

14. A firearm comprising the trunnion assembly of claim 1, wherein:

the trunnion insert is secured in the trunnion body; and the barrel is secured in the trunnion insert.

15. A trunnion assembly for a firearm, comprising:

a trunnion body defining an aperture extending therethrough;

a trunnion insert configured to be secured in the aperture, the trunnion insert defining an interior space in which a barrel of the firearm is receivable to mount the barrel to the trunnion body when the trunnion insert is secured in the aperture, wherein:

the interior space extends through the trunnion insert and includes an open forward end, an open rear end, and a passage extending from the open forward end to the open rear end, the open rear end is configured to receive a bolt of the firearm, and the open forward end is configured to receive the barrel into the passage; and at least one barrel fastener receivable through the trunnion body and the trunnion insert when the trunnion insert is received in the aperture to secure the trunnion insert in the trunnion body and substantially prevent the barrel from rotating when the barrel is received in the passage.

16. The trunnion assembly of claim 15, further comprising the barrel, wherein:

the barrel defines a flat surface configured to be engaged by the at least one barrel fastener when the barrel is received in the passage of the trunnion insert; and the at least one barrel fastener engages the flat surface to substantially prevent the barrel from rotating in the passage when the at least one barrel fastener secures the trunnion insert in the aperture of the trunnion body.

17. The trunnion assembly of claim 15, wherein:

the trunnion insert defines a longitudinal axis and at least one hole extending therethrough at an angle to the axis;

the trunnion body defines at least one through hole extending therethrough which aligns with the at least one hole extending through the trunnion insert when the trunnion insert is received in the aperture of the trunnion body; and the at least one barrel fastener is receivable in the respective holes of the trunnion insert and trunnion body when the trunnion insert is received in the aperture and the at least one hole extending through the trunnion insert is aligned with the at least one through hole extending through the trunnion body to secure the trunnion insert in the trunnion body and substantially prevent the barrel from rotating when the barrel is received in the passage.

18. A firearm comprising the trunnion assembly of claim 15, wherein:

the trunnion insert is secured in the trunnion body; and the barrel is secured in the trunnion insert.

* * * * *